US006935533B2

(12) United States Patent
Clausen et al.

(10) Patent No.: US 6,935,533 B2
(45) Date of Patent: Aug. 30, 2005

(54) REFRIGERATOR LIQUID DISPENSER

(75) Inventors: Kenneth F. Clausen, Doylsetown, OH (US); Lisa A. Kern, Northfield, OH (US); Rich Peterson, Franklin Park, IL (US)

(73) Assignee: Rubbermaid Incorporated, Wooster, OH (US)

( * ) Notice: Subject to any disclaimer, the term of this patent is extended or adjusted under 35 U.S.C. 154(b) by 40 days.

(21) Appl. No.: 10/446,281

(22) Filed: May 23, 2003

(65) Prior Publication Data

US 2004/0178222 A1 Sep. 16, 2004

Related U.S. Application Data

(60) Provisional application No. 60/382,756, filed on May 23, 2002.

(51) Int. Cl.[7] ..... B67D 5/60

(52) U.S. Cl. ..... 222/143; 222/157; 222/185.1; 222/465.1

(58) Field of Search ..... 222/143, 157, 222/158, 185.1, 465.1

(56) References Cited

U.S. PATENT DOCUMENTS

| | | | | |
|---|---|---|---|---|
| 2,134,865 A | * | 11/1938 | Essery | 222/130 |
| 2,726,795 A | | 12/1955 | Billock et al. | |
| 3,782,602 A | | 1/1974 | Page | |
| 4,143,795 A | * | 3/1979 | Casebier | 222/143 |
| 5,064,101 A | * | 11/1991 | Richter et al. | 222/143 |
| 5,105,858 A | * | 4/1992 | Levinson | 141/2 |
| 5,156,021 A | | 10/1992 | St-Gelais et al. | |
| 6,029,858 A | | 2/2000 | Srokose et al. | |
| 6,029,859 A | * | 2/2000 | Robbins, III | 222/158 |
| 6,050,455 A | * | 4/2000 | Soehnlen et al. | 222/185.1 |
| 6,065,646 A | | 5/2000 | Schwaikert | |
| 6,135,324 A | * | 10/2000 | Schmitt | 222/143 |

FOREIGN PATENT DOCUMENTS

| | | |
|---|---|---|
| FR | 2 461 216 | 1/1981 |
| FR | 2 543 127 | 9/1984 |
| JP | 11011451 | 1/1999 |
| WO | WO 91/10616 | 7/1991 |
| WO | WO 94/24011 | 10/1994 |

OTHER PUBLICATIONS

Copy of International Search Report for International Patent Application No. PCT/US03/16400, dated Jan. 2, 2004, 10 pages.

Copy of Written Opinion issued in International Patent Application No. PCT/US03/16400, dated Mar. 4, 2004, 9 pages.

Copy of International Preliminary Examination Report, dated Aug. 25, 2004, for International Patent Application No. PCT/US03/16400, 7 pages.

* cited by examiner

*Primary Examiner*—Joseph A. Kaufman
(74) *Attorney, Agent, or Firm*—Marshall, Gerstein & Borun LLP

(57) ABSTRACT

An improved liquid dispenser that is adapted to fit into a refrigerator and that is more user friendly is disclosed. The liquid dispenser includes a hollow body, a top, a bottom, and at least one wall therebetween. The body creates a receptacle for a liquid. The top includes an inlet for the receptacle and the at least one wall includes an outlet for the receptacle. A handle located near a central axis of the body is adapted to carry the liquid dispenser. The liquid dispenser may be stacked vertically with similar configured dispensers.

27 Claims, 4 Drawing Sheets

REFRIGERATOR LIQUID DISPENSER

RELATED APPLICATION DATA

The present application is a non-provisional application based on co-pending provisional application No. 60/382,756 which was filed on May 23, 2002.

FIELD OF THE DISCLOSURE

The present invention generally relates to a liquid dispenser and, more particularly, to a stackable water dispenser adapted to fit into a refrigerator.

BACKGROUND OF THE DISCLOSURE

Liquid containers and liquid dispensers are manufactured for several reasons, and are sometimes designed for a particular use or purpose. Pitchers, for example, such as the ones used to mix water with concentrated ice tea, lemonade, frozen orange juice, etc. are of a generally cylindrical shape having an openable top and a carrying handle on the side. The pitcher, however, has several downsides which make the pitcher very limited in its use and makes the pitcher difficult to use. The pitcher, for example, can be very difficult to transport from one location to another, such as carrying the pitcher from the countertop of the kitchen to the refrigerator, when filled with liquid, is very heavy and difficult to carry. The pitcher is difficult to carry, partially, because the carrying handle is located toward a side of the pitcher, placing the pitcher's weight away from its center of gravity. Similarly, to receive the contents of the pitcher, the user must remove the entire pitcher from the refrigerator, fill a glass, and then return the pitcher to the refrigerator. The user, especially if elderly or very young may have difficulty removing and returning the heavy pitcher, as well as carrying and pouring the filled pitcher.

Drink coolers, such as the ones used for picnicking, for sporting events, and on golf courses are relatively large and have an openable top and a tap. These drink coolers hold a large amount of liquid and make it easy to dispense the liquid by utilizing a tap. These coolers, however, are very difficult to carry due to their large size and weight. Furthermore, the coolers are difficult to keep cool for extended periods of time, and typically will not fit into the average sized refrigerator.

Other liquid containers include those that are especially designed for the storage and dispensing of water. These water dispensers come in several forms, including those that resemble pitchers, and those that resemble small drink coolers. For example, water dispensers that resemble pitchers may have the same general shape and features as a pitcher, but may include a filter for filtering tap water. Similar to pitchers, these water dispensers are difficult to carry and may be difficult to use.

The water dispensers that resemble small drink coolers solve some of the above problems due to the addition of taps for dispensing the water when the cooler is in the refrigerator. However, these water dispenser do not solve all the above problems and create others. For instance, even though the user can obtain water without having to remove the dispenser from the refrigerator, the user will eventually have to refill the dispenser by removing it from the refrigerator, filling it, and returning it to the refrigerator. These type of water dispensers usually do not have handles or other means to carry the dispenser to the refrigerator, making it difficult to transport the dispenser. Similarly, these type of water dispensers are usually large and cumbersome, and often have a shape designed to make the dispenser aesthetically pleasing. Unfortunately, these designs greatly limit a dispensers practicability because of the large amount of space they require. More specifically, the dispensers take up a large amount of shelf space when placed next to each other.

Water jugs, such as the ones containing water when bought in a store are also another type of liquid dispenser. These water jugs usually incorporate a handle to enable the shopper to transport the jug from the store to the home. The water jugs sometimes also include taps that allow the user to obtain water from the jug without having to remove it from the refrigerator. These water jugs, however, are intended for a one time use, and do not have an inlet which allows for the replenishing of water and/or the addition of flavor or concentrate, such as from powder or orange juice. These jugs also take up a large amount of shelf space in a refrigerator.

SUMMARY OF THE DISCLOSURE

An improved liquid dispenser is disclosed that is adapted to fit into a refrigerator and that is more user friendly. In accordance with one aspect of the disclosure, the liquid dispenser includes a body having a top, a bottom, and at least one wall therebetween is disclosed. The body creates a storage receptacle for a liquid. The top includes an inlet and the at least one wall includes an outlet. A handle is located near a central axis of the body for lifting the dispenser. The dispenser is stackable with similarly constructed dispensers.

Figure 1:
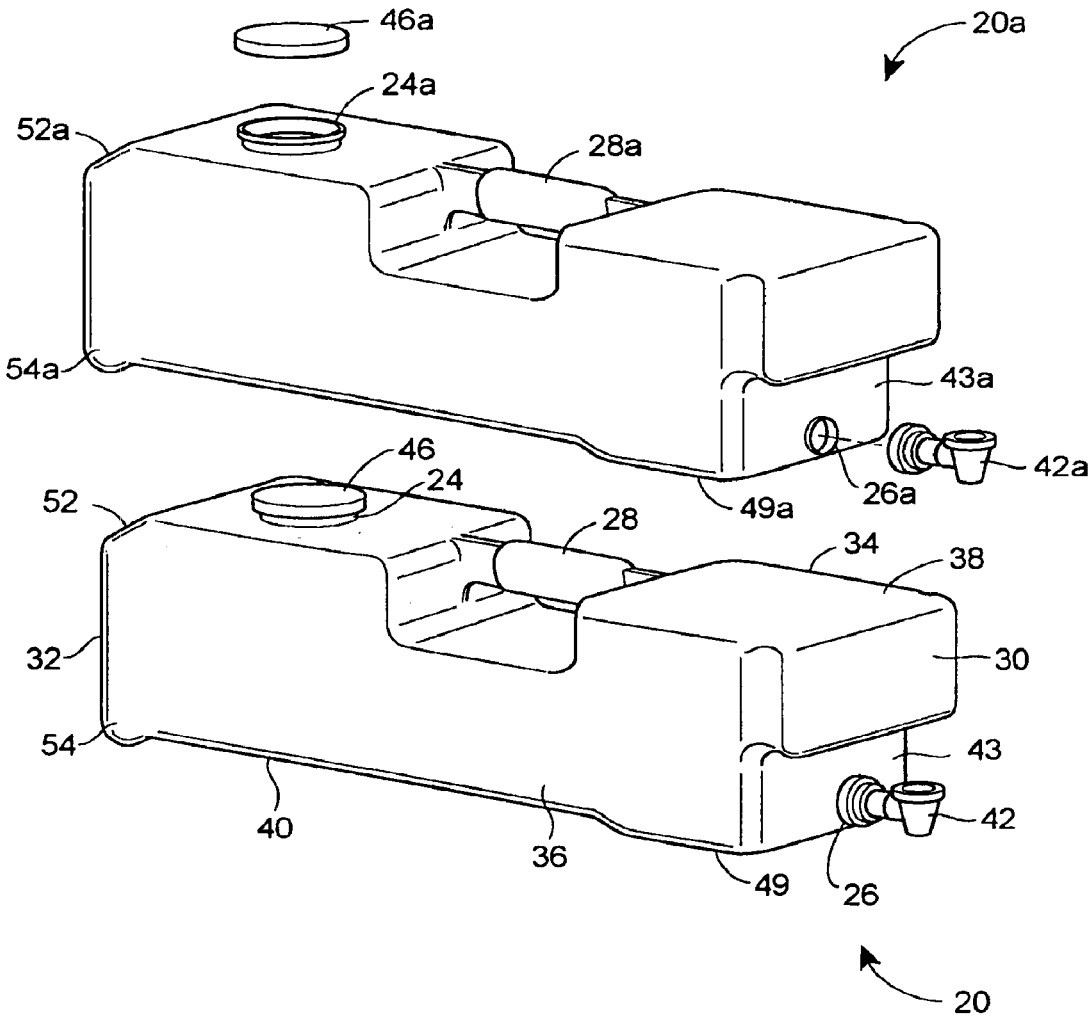
FIG. 1 is a perspective view of two liquid dispensers each constructed in accordance with the teachings of the present invention.

While the method and device described herein are susceptible to various modifications and alternative constructions, certain illustrative embodiments thereof are shown in the drawings and are described below in detail. It should be understood, however, that there is no intention to limit the invention to the specific forms disclosed, but on the contrary, the intention is to cover all modifications, alternative constructions, and equivalents falling within the spirit and scope of the invention and the appended claims.

DETAILED DESCRIPTION

Referring now to the drawings, and with specific reference to FIG. 1, liquid dispensers constructed in accordance with the teachings of the disclosure are generally depicted by reference numerals 20 and 20*a*.

The liquid dispenser 20 and the second liquid dispenser 20*a* will herein be described simultaneously for ease of understanding and brevity. It should be understood that the liquid dispenser 20 and the liquid dispenser 20*a* are substantially similar and as such, share the same features. Therefore, a feature that is described as being part X of the liquid dispenser 20 may also be a feature on the liquid dispenser 20*a*, but be identified as Xa, and vice-versa. The features of the disclosed liquid dispenser will generally be described herein with reference to the dispenser 20.

The liquid dispenser 20 can be used to contain and dispense any number of liquids including, but not limited to, water, ice tea, lemonade, milk, mixed drinks, juices, and the like, but will herein be described as being used for dispensing water. Similarly, the liquid dispenser 20 can be used in many places including, but not limited to, a kitchen, a refrigerator, the outdoors, and a workplace environment, but will herein be described as being used in a refrigerator.

The liquid dispenser 20 can be fabricated from relatively light weight, durable, and sturdy plastic materials such as polyethylene, polypropylene, polystyrene, or other suitable plastic materials. Similarly, the color of the materials can vary such that the liquid dispenser 20 may have a variety of materials and/or a variety of colors including clear. The liquid dispenser 20 can also be injection molded, blow molded, continuously molded, extruded, vacuum formed, or the like. The manufacturing process or processes and materials can be selected based on feasibility, cost, tooling concerns, as well as other factors for a given application.

Figure 3:
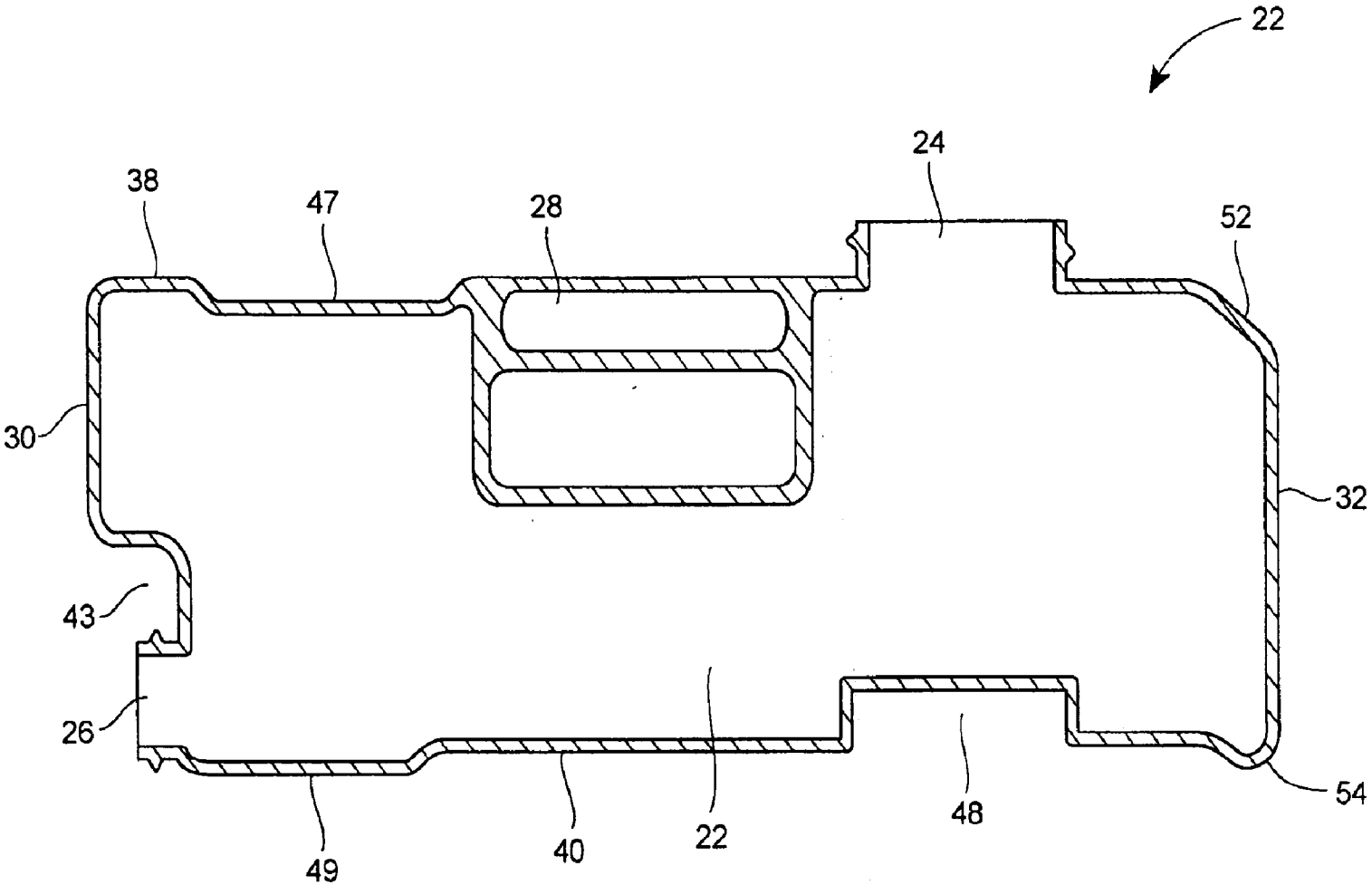
FIG. 3 is a cross-sectional view taken along lines III—III of the liquid dispenser of FIG. 2.

In one exemplary embodiment, as shown therein, the liquid dispenser 20 includes a hollow body 22 having an inlet 24, an outlet 26, and a handle portion 28. The body 22 of the liquid dispenser 20, as illustrated in FIGS. 1 and 3, includes a front side 30, a rear side 32, a first or right side 34, a second or left side 36, an upper side 38, and a lower side 40. The body sides are configured such that at least a hollow portion of body 22 creates an interior receptacle for the water. More specifically, the upper side 38, the lower side 40, the first side 34, and the second side 36 all have a generally elongate rectangular two-dimensional shape, and the front side 30 and rear side 32 have a generally square two-dimensional shape in this example. The shapes of the liquid dispenser 20 may vary, and may be triangular, square, rounded, or any other shape adaptable to be stacked.

In another exemplary embodiment, the front side 30 of the liquid dispenser 20 defines the outlet 26. A valve mechanism 42 cooperates with the outlet 26 to open and close a flow of water from the liquid dispenser 20. The valve mechanism 42, located near the bottom side 40 of the front side 30 can include, but is not limited to, a spigot, a valve, a plug, and a tap. The valve mechanism 42 can be made from several different parts and may use various technologies, but is generally adapted to receive manual input from a user to open and close the flow of water from the liquid dispenser 20. The valve mechanism 42 can be detachable from the outlet 26 and may, therefore, as in this example, be threadably attached to the outlet. In another example, the front side 30 can include a rearwardly recessed area 43 located toward the lower side 40 (FIG. 3). The outlet 26 and/or at least part of the valve mechanism 42, as in this example, can be located on the recessed area 43 to limit the distance the valve mechanism 42 protrudes past the front side 30 and/or to maximize the receptacle area for the liquid.

Figure 2:
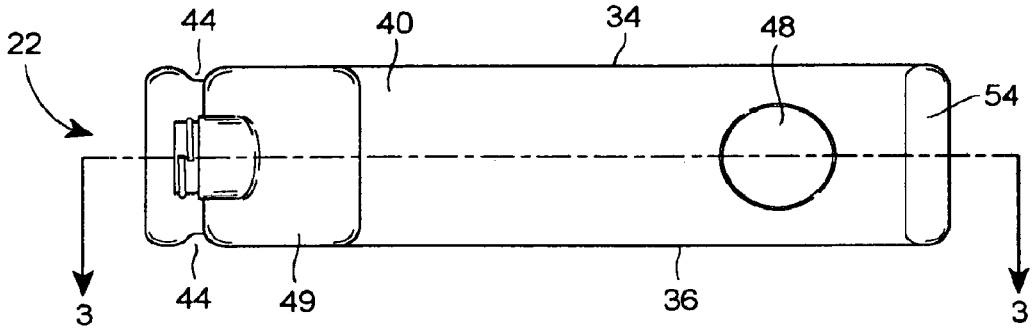
FIG. 2 is a bottom view of a liquid dispenser of FIG. 1.

In another exemplary embodiment, one or more grasping features 44 (FIG. 2) can be located near the front side 30, on the first side 34 and/or the second side 36. The grasping features 44 can, for example, be a handle, a groove or recess, or the like, such as vertically oriented finger recesses in this example, adapted to enable the user to grasp and move the liquid dispenser 20 forward and rearward. More specifically, the grasping features 44 may be provided to enable the user to remove the liquid dispenser 20 from the refrigerator. The features 44 can be an area or feature that the user can grasp or hold such that the dispenser 20 can be pulled toward the user.

In one exemplary embodiment, the upper side 38 of the liquid dispenser 20 includes the inlet 24 and the handle 28. The inlet 24 in this example is round and located toward the rear side 32 of the upper side 38. The inlet 24 is closeable and includes a lid 46 that can be threadably attached to the inlet 24. The lid 46 may, however, be attached to the inlet 24 by several different other means, such as by a hinge arrangement, a snapping arrangement, or a detent construction to retain the lid 46 onto the inlet 24. The inlet 24 and the lid 46 can protrude from the upper side 38, as in this example, such that the inlet 24 and the lid 46 are above the surface created by the upper side 38. In another example, the inlet 24 and/or the lid 46 can be recessed into the upper side 38, such that the top of the inlet 24 and/or the lid 46 are flush with or below the surface created by the upper side 38. Further, the inlet need not be round, but instead can be any shape including, but not limited to, square, oval rectangular, triangular, or a combination thereof.

In one exemplary embodiment, the upper side 38 of the liquid dispenser 20 further includes a first recess portion 47 (optionally shown in FIGS. 3 and 4) located toward the front side 30 of the liquid dispenser 20. The first recess portion 47 is recessed below remaining portions of the upper side 38 and in this example is adapted to receive and nest with a corresponding shaped first protrusion 49*a* located on the bottom side 40 toward the front side 30 of the liquid dispenser 20*a*.

In one exemplary embodiment, the handle 28, similar to the inlet 24 and/or the lid 46, can protrude from the upper side 38 such that at least part of handle 28 is above the surface created by the upper side 38. In another embodiment, the handle 28 is recessed into the upper side 38, as in this example, such that the top of the handle 28 is flush with or below the surface created by the upper side 38. The handle 28 is located toward the center of the liquid dispenser 20, as in this embodiment, and more specifically, toward the center of the upper side 38 such that the handle location allows the user to better carry the liquid dispenser 20. More specifically, when carrying the liquid dispenser 20, it is preferred to have the handle 28 of the liquid container 20 located near or along the line of the liquid container's center of gravity, such that the container 20 is well balanced around the handle 28. If the handle is located away from the liquid dispenser's center of gravity or not in-line therewith, then a moment is created about the handle 28, thereby making it difficult to carry and/or hold the liquid dispenser level and without spilling.

The handle 28 can be manufactured as a separate piece from the body 22 or as an integrated piece of the body 22. In one embodiment, to prevent the water from entering the handle 28, the handle 28 can either be solid or have first and second ends that are crimped or otherwise restricted so to prevent water from entering the handle 28, thereby making the handle 28 not a part of the receptacle. Alternatively, the handle 28 can be hollow and define part of the interior liquid receptacle.

Figure 4:
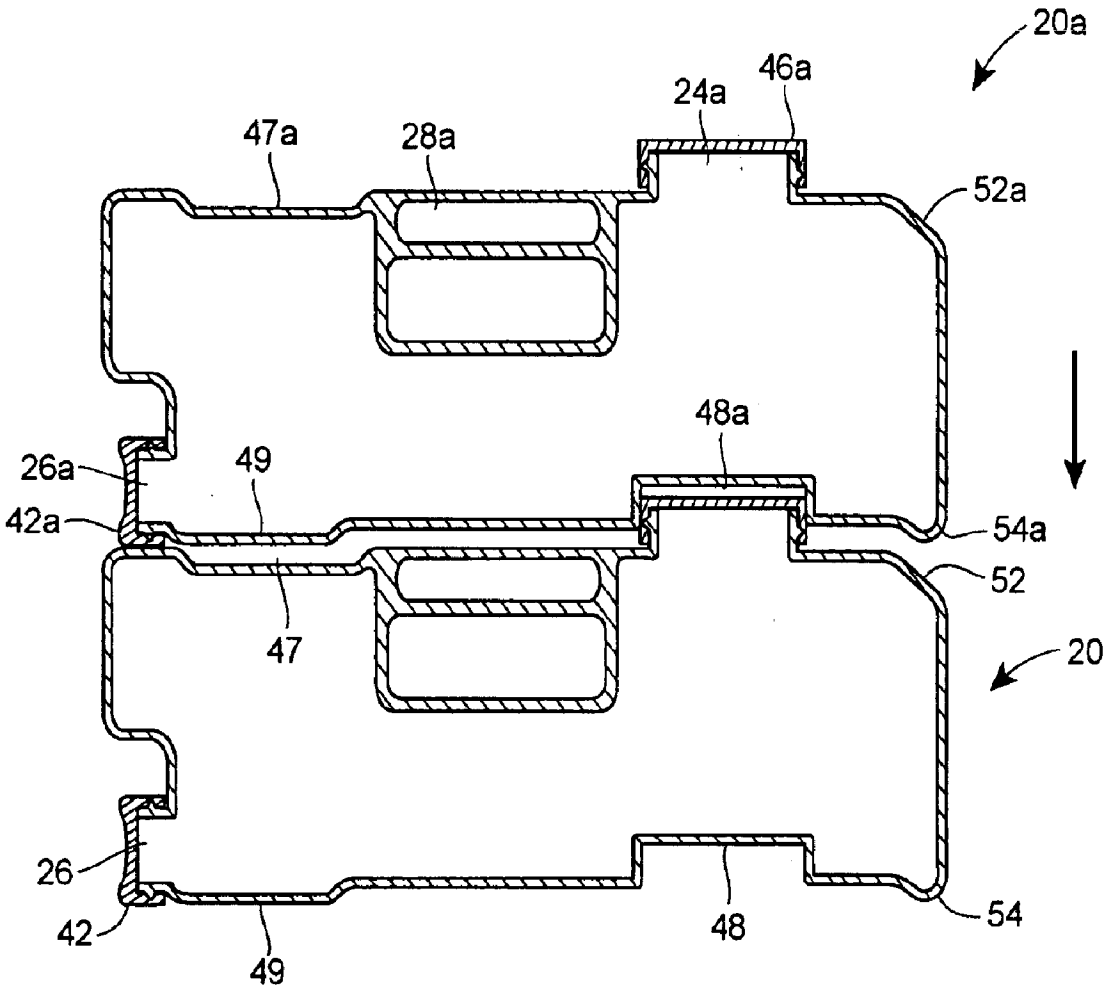
FIG. 4 is a cross-sectional view of two stacked liquid dispensers similar to FIG. 3.

In one exemplary embodiment, as illustrated in FIGS. 1 and 4, the lower side 40*a* of the liquid dispenser 20*a* includes an inlet receiving recess 48*a* located toward the rear side 32*a*. The recess 48*a* can receive the protruding inlet 24 and/or lid 46 from the liquid dispenser 20. The recess 48*a* can, therefore, be located anywhere along the lower side 40*a* and sized to compliment the inlet 24 and/or lid 46 of the liquid dispenser 20. The recess 48*a* can be dimensioned either to provide a clearance for the inlet 24 and/or lid 46 or to positively engage with the inlet 24 and/or lid 46, thereby providing a means to connectively engage one or more stacked liquid dispensers 20. The lower side 40*a* may also include the protruding area 49*a* located toward the center of the front side 30*a*. The protruding area 49*a* may be adapted to engage the first recess portion 47 from the liquid dispenser 20. The protruding area 49*a* may, therefore, be located anywhere along the lower side 40*a* and be sized to compliment the first recess portion 47 of the liquid dispenser 20. If, however, there is no first recess portion 47, the lower side 40*a* need not include the protruding area 49*a*.

In one embodiment, the liquid dispensers 20*a* may include one or more additional features adapted to enable the liquid dispenser 20*a* to be stacked or otherwise engaged with one or more additional liquid dispensers 20. For example, the lower side 40*a* may include, near the rear side 32*a*, a ridge 54*a* designed to complement a chamfer 52 located on the upper side 38 near the rear side 32 of the liquid dispenser 20. Additional complimentary recesses and receptacles can also be provided.

In operation, the liquid dispenser 20 can be used as a single unit or with one or more additional liquid dispensers. The liquid dispenser 20 can also be placed on any generally flat surface, such as on a table, a shelf, on the ground, or on any other substantially planer surface. For descriptive reasons alone, however, the liquid dispenser 20 will herein be described as being used on a refrigerator shelf and stacked with the liquid dispenser 20*a*.

The user can open the liquid dispenser 20 by unscrewing or otherwise removing the lid 46 from the inlet 24. Once opened, the user can fill the liquid dispenser 20 by pouring water into the interior receptacle through the inlet 24. The inlet 24 can be large enough to allow the user to also place additional substances into liquid dispenser 20, such as iced tea mix, orange juice concentrate, or the like. Similarly, the inlet 24 can be sized for a user to insert a hand into the liquid dispenser 20 for cleaning the interior receptacle. In one example, the liquid dispenser 20 can be adapted to receive a filter (not shown) to filter water between the inlet 24 and the outlet 26. The filter may be of the kind that attaches to and/or is located near the inlet 24 to allow the water to be filtered while being poured into the liquid dispenser 20. In another example, the filter may be located between one or more compartments (not shown) in the liquid dispenser 20, to allow the water to be collected in a first compartment in the liquid dispenser 20 and be filtered into a second compartment in liquid dispenser 20.

Once the user has filled the liquid dispenser 20 to a desired level, which may be aided by the liquid dispenser 20 being constructed from clear material, the user can replace the lid 46 onto the inlet 24, thereby preventing the water from spilling or leaking from the liquid dispenser 20. To transport the liquid dispenser 20, the user can take hold of the handle 28 and pick up the liquid dispenser 20. The handle being positioned toward the center of the upper side 38 will enable the user to carry the liquid dispenser 20 without twisting or bending the user's wrist.

Figure 5:
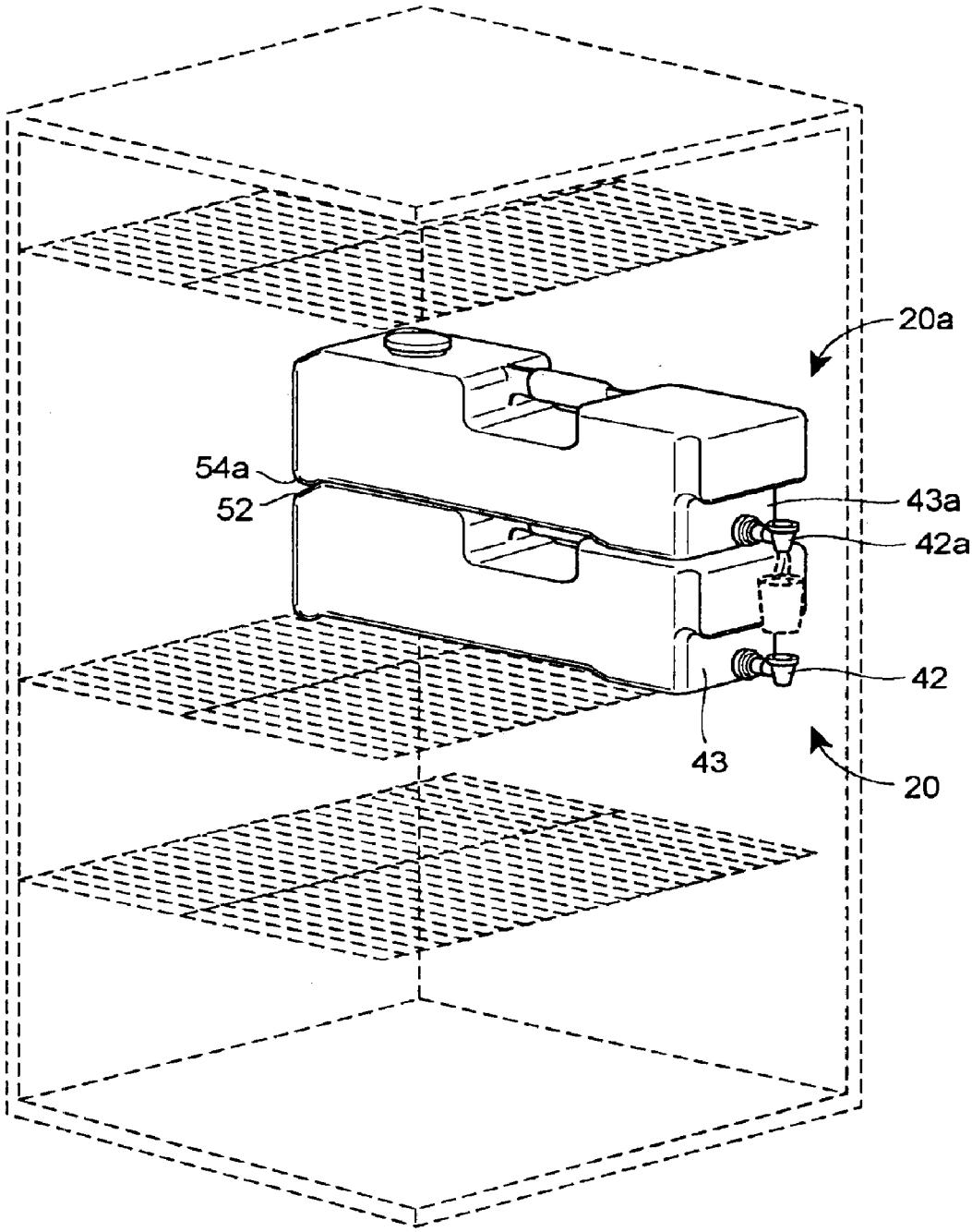
FIG. 5 is a perspective view of two stacked liquid dispensers as they may be used in a refrigerator.

The user can place the liquid dispenser 20 into the refrigerator, as illustrated in FIG. 5, by first inserting the rear side 32 of the liquid dispenser 20 into the refrigerator and then placing the lower side 40 of the liquid dispenser 20 onto a refrigerator shelf. The user can then adjust the location of the liquid dispenser 20 relative to the refrigerator shelf utilizing the gripping features, if present, such that the valve mechanism 42 protrudes past the edge of the refrigerator shelf. If desired, the user can place the second liquid dispenser 20*a* on top of the first liquid dispenser 20 in a similar manner.

The stacked dispensers 20 and 20*a* will nest with one another when placing the second liquid dispenser 20*a* onto the first liquid dispenser 20. The ridge 54*a* of the liquid dispenser 20*a* in this example, will nest with the chamfer 52 of the liquid dispenser 20. Similarly, the inlet receiving recess 48*a* on the lower side 40 of the liquid dispenser 20*a* will nest with the inlet 24 and/or lid 46 of the liquid dispenser 20. Also, the first protrusion 49*a* on the lower side 40*a*, will nest with the first recess 47 portion of the liquid dispenser 20. If properly stacked in such a manner, the liquid dispenser 20 and the liquid dispenser 20*a* can now be securely held in the refrigerator.

The user can now use the liquid dispenser 20 by placing a cup underneath outlet 26 and by opening the valve mechanism 42, thereby allowing liquid to flow into the cup. Similarly, if the user desires to obtain liquid from the liquid dispenser 20*a*, the user can place the cup into the area between the valve mechanism 42 and the valve mechanism 42*a*, and open the valve mechanism 42*a*, thereby also allowing the flow of water into the cup.

The foregoing detailed description has been given for clearness of understanding only and no unnecessary limitations should be understood therefrom, as modifications will be apparent to those skilled in the art.

What is claimed is:

1. A stackable liquid dispenser comprising:

a hollow body defining a receptacle for a liquid and having a top, a bottom, and at least one wall therebetween, an inlet located in the top of the body;

an outlet in the at least one wall near the bottom of the body; and a hollow handle provided on the top of the body for lifting the dispenser, the hollow handle being fluidly separated from the hollow body, wherein the top, bottom, outlet, and handle are configured so that the dispenser can be stacked vertically with similarly configured dispensers.

2. The liquid dispenser of claim 1, wherein the inlet includes a removable lid.

3. The liquid dispenser of claim 1, wherein the outlet includes a manually operable valve.

4. The liquid dispenser of claim 1, wherein the body includes at least one grasping feature located on the at least one wall for manually grasping the dispenser.

5. The liquid dispenser of claim 1, wherein the dispenser is constructed from one of a polyethylene, polypropylene, and polystyrene material.

6. The liquid dispenser of claim 1, wherein the dispenser is constructed from a substantially transparent material.

7. The liquid dispenser of claim 1, wherein the bottom of the dispenser includes an inlet receiving recess for receiving an inlet projecting upward from a top of a second liquid dispenser.

8. The liquid dispenser of claim 1, wherein the body has a generally elongate rectangular shape and is sized to fit lengthwise into a standard refrigerator.

9. The liquid dispenser of claim 8, including a front wall wherein the outlet is positioned near the bottom of the front wall.

10. The liquid dispenser of claim 1, wherein at least a portion of the receptacle overhangs the outlet.

11. The liquid dispenser of claim 1, wherein the handle is not part of the receptacle.

12. A stackable liquid dispenser comprising:

a hollow body defining a receptacle for a liquid and having a top, a bottom, a front side, a rear side, a right side and a left side;

an inlet located in the top of the body;

an outlet in the at least one wall near the bottom of the body; and a hollow handle provided on the top of the body for lifting the dispenser, wherein first and second ends of the hollow handle are crimped, and wherein the top, bottom, outlet, and handle are configured so that the dispenser can be stacked vertically with similarly configured dispensers.

13. The liquid dispenser of claim 12, wherein the inlet includes a removable lid.

14. The liquid dispenser of claim 12, wherein the outlet includes a manually operable valve.

15. The liquid dispenser of claim 12, wherein the body includes at least one grasping feature located on one of the right side and the left side for manually grasping the dispenser.

16. The liquid dispenser of claim 12, wherein the dispenser is constructed from one of a polyethylene, polypropylene, and polystyrene material.

17. The liquid dispenser of claim 12, wherein the dispenser is constructed from a substantially transparent material.

18. The liquid dispenser of claim 12, wherein the bottom of the dispenser includes an inlet receiving recess for receiving an inlet projecting upward from a top of a second liquid dispenser.

19. The liquid dispenser of claim 12, wherein the body has a generally elongate rectangular shape and is sized to fit lengthwise into a standard refrigerator.

20. The liquid dispenser of claim 12, wherein at least a portion of the receptacle overhangs the outlet.

21. The liquid dispenser of claim 12, wherein the handle is not part of the receptacle.

22. The liquid dispenser of claim 12, wherein a protrusion located on the bottom near the front of the dispenser is adapted to engage with a recess located on the top near the front of another liquid dispenser.

23. The liquid dispenser of claim 12, wherein a ridge located on the bottom near the rear of the dispenser is adapted to engage with a chamfer located on the top near the rear of another liquid dispenser.

24. A stackable liquid dispenser having a receptacle for holding a liquid comprising:

a top having an inlet for the receptacle and at least one feature adapted to rest in another liquid dispenser stacked on the top;

a bottom having at least one feature adapted to rest with another liquid dispenser stacked beneath the bottom;

a front side, a rear side, a right side and a left side connecting the top to the bottom, the front side has an overhanging upper part protruding forward beyond a lower part, an outlet for the receptacle located near the bottom in the lower part of the front side, wherein the outlet is located at least partially beneath the overhanging upper part of the front side; and a hollow handle located in the top of the body for lifting the dispenser, wherein the hollow handle is fluidly closed off from the receptacle.

25. The liquid dispenser of claim 24, wherein the inlet includes a lid.

26. The liquid dispenser of claim 24, wherein the outlet includes a valve.

27. The liquid dispenser of claim 24, wherein the dispenser is transparent and is constructed from one of a polyethylene, polypropylene, and polystyrene material.

* * * * *